US008414306B2

(12) United States Patent
Tagawa et al.

(10) Patent No.: US 8,414,306 B2
(45) Date of Patent: Apr. 9, 2013

(54) COAXIAL CONNECTOR WITH AN INSULATING BASE WITH GROOVES BETWEEN GROUNDING AND SIGNAL CONTACTING CONDUCTORS

(75) Inventors: Tetsuya Tagawa, Fukuoka (JP); Katsuaki Obayashi, Kanagawa (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/202,526

(22) PCT Filed: Jul. 8, 2009

(86) PCT No.: PCT/JP2009/003180

§ 371 (c)(1), (2), (4) Date: Aug. 19, 2011

(87) PCT Pub. No.: WO2010/109550

PCT Pub. Date: Sep. 30, 2010

(65) Prior Publication Data

US 2012/0009817 A1 Jan. 12, 2012

(30) Foreign Application Priority Data

Mar. 27, 2009 (JP) ..... 2009-079688

(51) Int. Cl.
*H01R 12/00* (2006.01)

(52) U.S. Cl. ..... 439/63

(58) Field of Classification Search ..... 439/63, 439/578, 74, 108

See application file for complete search history.

(56) References Cited

U.S. PATENT DOCUMENTS

| | | | | |
|---|---|---|---|---|
| 6,074,217 | A * | 6/2000 | Maruyama et al. | 439/63 |
| 6,902,408 | B2 | 6/2005 | Yamane | |
| 7,198,492 | B2 | 4/2007 | Shichida et al. | |
| 7,334,327 | B1 * | 2/2008 | Chen et al. | 29/876 |
| 7,651,334 | B2 * | 1/2010 | Zhang | 439/63 |
| 7,976,315 | B2 * | 7/2011 | Zuinen et al. | 439/63 |
| 2004/0137764 | A1 | 7/2004 | Yamane | |
| 2006/0141811 | A1 | 6/2006 | Shichida et al. | |

FOREIGN PATENT DOCUMENTS

| | | | |
|---|---|---|---|
| JP | 08-321361 | A | 12/1996 |
| JP | 2003-257567 | A | 9/2003 |
| JP | 2003-297491 | A | 10/2003 |
| JP | 2004-031187 | A | 1/2004 |
| JP | 2004-221055 | A | 8/2004 |
| JP | 2008-123873 | A | 5/2008 |

OTHER PUBLICATIONS

International Search Report; PCT/JP2009/003180; Aug. 4, 2009.

* cited by examiner

*Primary Examiner* — Chandrika Prasad

(74) *Attorney, Agent, or Firm* — Studebaker & Brackett PC; Donald R. Studebaker

(57) ABSTRACT

A coaxial connector device which comprises an insulated base placed on a circuit board, a signal-joining contacting conductor fixed to the insulating base with a contact connecting portion and an signal-connecting portion, and a grounding contacting conductor fixed to the insulating base with a cylindrical side wall portion surrounding the contact connecting portion, ground-connecting portions and connecting portions for connecting the cylindrical side wall portion with each of the ground-connecting portions, wherein a groove is formed between the grounding contacting conductor and the signal-joining contacting conductor on the insulating base and at least one of the connecting portions is deformed for becoming distant from the signal-joining contacting conductor.

5 Claims, 5 Drawing Sheets

COAXIAL CONNECTOR WITH AN INSULATING BASE WITH GROOVES BETWEEN GROUNDING AND SIGNAL CONTACTING CONDUCTORS

TECHNICAL FIELD

The invention disclosed in each of the claims of the present application relates to a coaxial connector device which is mounted on a circuit board for transmitting signals from the circuit board to the outside thereof or for taking signals into the circuit board from the outside thereof under a condition of electro-magnetic shield.

TECHNICAL BACKGROUND

A high-frequency signal flowing through conductors arranged on a circuit board to be transmitted from the circuit board to the outside thereof or a high-frequency signal taken into the conductors on the circuit board from the outside thereof is mostly dealt with as a signal which requires being put in a condition of electro-magnetic shield so as to prevent noises from mixing thereinto from the outside or to be inactive to leak out from the conductors on the circuit board. For transmitting the high-frequency signal from the circuit board to the outside thereof or for taking the high-frequency signal into the circuit board from the outside thereof, for example, through a coaxial cable, under the condition of electro-magnetic shield, a coaxial connector device provided to be mounted on a circuit board is used. With the coaxial connector device thus mounted on the circuit board, for example, another coaxial connector device (a mating coaxial connector device) connected with a coaxial cable through which the high-frequency signal is transmitted is coupled.

Such a coaxial connector device provided to be mounted on the circuit board comprises usually an insulating base operative to face close the circuit board, a signal-joining contacting conductor fixed to the insulating base for transferring a signal and a grounding contacting conductor fixed also to the insulating base and having a cylindrical side wall portion which surrounds the signal-joining contacting conductor to be supplied with a grounding potential so as to put the signal supplied to the signal-joining contacting conductor in a condition of electro-magnetic shield. When the coaxial connector device is mounted on a circuit board to be used, a mating coaxial connector device, to which a coaxial cable is connected, for example, is coupled with the coaxial connector device, so that the signal-joining contacting conductor comes into contact with another signal-joining contacting conductor provided in the mating coaxial connector device and the grounding contacting conductor comes into contact with another grounding contacting conductor provided in the mating coaxial connector device. With the coaxial connector device and the mating coaxial connector device coupled with each other in such a manner, a signal which requires being put in a condition of electro-magnetic shield is transferred, for example, through the coaxial cable connected to the mating coaxial connector device, under the condition of electro-magnetic shield which is brought about by the grounding contacting conductor having the cylindrical side wall portion for surrounding the signal-joining contacting conductor in the coaxial connector device. (As disclosed in, for example, patent document 1.)

When the previously proposed coaxial connector device such as disclosed in patent document 1 is mounted on the circuit board, the insulating base to which the signal-joining contacting conductor (a central conductor) and the grounding contacting conductor (an outside conductor) are fixed is placed on the circuit board to face close the same, the signal-joining contacting conductor is connected to a signal terminal provided on the circuit board and the grounding contacting conductor is connected to a ground-potential terminal provided on the circuit board. It is usual that a signal-joining terminal portion (a connecting portion) of the signal-joining contacting conductor is soldered to the signal terminal provided on the circuit board so that the signal-joining contacting conductor is connected to the signal terminal and a grounding terminal portion (a leg portion) of the grounding contacting conductor is soldered to the ground-potential terminal provided on the circuit board so that the grounding contacting conductor is connected to the ground-potential terminal. Therewith, the coaxial connector device is put in a condition for engaging with or disengaging from the mating coaxial connector device.

PRIOR ART DOCUMENTS

Patent Documents

Patent document 1: Japanese Patent Publication No. 2004-221055 (Pages 5 to 7, FIGS. 1 to 6)

SUMMARY OF THE INVENTION

Problems Intended to be Solved by the Invention

In the above-mentioned previously proposed coaxial connector device which comprises the insulating base operative to face close the circuit board, the signal-joining contacting conductor fixed to the insulating base and the grounding contacting conductor fixed also to the insulating base and having the cylindrical side wall portion which surrounds the signal-joining contacting conductor for transferring the ground potential and is mounted on the circuit board to be used, it is desired that a characteristic impedance against a signal supplied to the signal-joining contacting conductor is set to be a predetermined value which is, for example, a value matching with a characteristic impedance presented by the coaxial cable coupled with the coaxial connector device through the mating coaxial connector device, so as to prevent a high-frequency signal supplied to the coaxial connector device from being reflected from the coaxial connector device and thereby to bring about improvement in efficiency of signal transmission. For example, since the characteristic impedance of the coaxial cable is generally determined to be 50Ω, it is desired that the characteristic impedance of the coaxial connector device is set also to be 50Ω. That is, a desirable and appropriate characteristic impedance of the coaxial connector device is 50Ω.

The characteristic impedance of the coaxial connector device mounted on the circuit board is determined in response to impedance between the signal-joining contacting conductor and the grounding contacting conductor, which is influenced by dielectric constant of an insulator (meaning to include air) between the signal-joining contacting conductor and the grounding contacting conductor. In the previously proposed coaxial connector device as mentioned above, a space between the signal-joining contacting conductor and the grounding contacting conductor is filled with the insulating base which presents usually a specific dielectric constant more than 1. Accordingly, for example, for obtaining the characteristic impedance of 50Ω which is the desirable and appropriate characteristic impedance of the coaxial connector device, it is necessary for the coaxial connector device to have a relatively large interval between the signal-joining contacting conductor and the grounding contacting conductor. However, the coaxial connector device provided to be mounted on the circuit board is required to be miniaturized on the whole in accompaniment with downsizing of other electronic parts provided to be mounted on the circuit board and the circuit board in itself and therefore it is quite difficult for the coaxial connector device to have the relatively large interval between the signal-joining contacting conductor and the grounding contacting conductor.

As explained above, the previously proposed coaxial connector device is required to be miniaturized on the whole so that it is quite difficult for the previously proposed coaxial connector device to present the desirable and appropriate characteristic impedance, for example, the characteristic impedance of 50Ω. Therefore, the coaxial connector device proposed previously is compelled to have reluctantly characteristic impedance less than 50Ω. That is, the previously proposed coaxial connector device is put in a situation wherein miniaturization on the whole is incompatible with presentation of the desirable and appropriate characteristic impedance.

Accordingly, it is an object of the invention disclosed in each of the claims of the present application to provide a coaxial connector device which comprises an insulating base operative to face close a circuit board, a signal-joining contacting conductor fixed to the insulating base and a grounding contacting conductor fixed also to the insulating base and having a cylindrical side wall portion which surrounds the signal-joining contacting conductor for transferring ground potential and is mounted on the circuit board to be used, and with which miniaturization on the whole is compatible with presentation of a desirable and appropriate characteristic impedance which is, for example, of a value matching with characteristic impedance presented by a coaxial cable connected to a mating coaxial connector device operative to engage with the coaxial connector device.

Approach to Solve the Problems

According to the invention claimed in any one of claims 1 to 5 (hereinafter, referred to as the present invention), there is provided a coaxial connector device, which comprises an insulating base provided to be placed on a surface of a circuit board, a signal-joining contacting conductor fixed to the insulating base with a contact connecting portion operative to project from the insulating base and an signal-connecting portion provided on a portion for facing close the surface of the circuit board (hereinafter, referred to as a circuit board facing portion) of the insulating base to be connected to a signal terminal provided on the circuit board, and a grounding contacting conductor fixed also to the insulating base with a cylindrical side wall portion for surrounding the contact connecting portion of the signal-joining contacting conductor along the surface of the circuit board, a plurality of ground-connecting portions provided around the contact connecting portion and the signal-connecting portion of the signal-joining contacting conductor on the circuit board facing portion of the insulating base to be connected to ground-potential terminals provided on the circuit board, and a plurality of connecting portions provided for connecting an annular end of the cylindrical side wall portion and each of the ground-connecting portions, wherein at least one groove is formed between the ground-connecting portion of the grounding contacting conductor and the contact connecting portion of the signal-joining contacting conductor and between the ground-connecting portion of the grounding contacting conductor and the signal-connecting portion of the signal-joining contacting conductor on the circuit board facing portion of the insulating base for surrounding continuously or intermittently the contact connecting portion and the signal-connecting portion of the signal-joining contacting conductor, and wherein at least one of the connecting portions is deformed for becoming distant from the signal-joining contacting conductor.

In the coaxial connector device thus constituted in accordance with the present invention, the signal-joining contacting conductor which has a contact connecting portion for projecting from the insulating base and the signal-connecting portion provided on the circuit board facing portion of the insulating base to be connected to the signal terminal provided on the circuit board, and the grounding contacting conductor which has the cylindrical side wall portion for surrounding the contact connecting portion of the signal-joining contacting conductor along the surface of the circuit board and the ground-connecting portion provided around the contact connecting portion and the signal-connecting portion of the signal-joining contacting conductor on the circuit board facing portion of the insulating base to be connected to the ground-potential terminal provided on the circuit board, are fixed to the insulating base provided to be placed on the surface of the circuit board. Then, between the ground-connecting portion of the grounding contacting conductor and the contact connecting portion of the signal-joining contacting conductor and between the ground-connecting portion of the grounding contacting conductor and the signal-connecting portion of the signal-joining contacting conductor on the circuit board facing portion of the insulating base, the groove is formed in such a manner as to surround continuously or intermittently the contact connecting portion and the signal-connecting portion of the signal-joining contacting conductor, and at least one of the connecting portions provided in the grounding contacting conductor is subjected to deformation for becoming distant from the signal-joining contacting conductor.

When the coaxial connector device according to the present invention is mounted on the circuit board to be put to practical use, the insulating base is placed on the circuit board so as to cause the circuit board facing portion of the insulating base, on which the groove is formed, to face close the surface of the circuit board, the signal-connecting portion of the signal-joining contacting conductor is connected to the signal terminal provided on the circuit board and the ground-connecting portion of the grounding contacting conductor is connected to the ground-potential terminal provided on the circuit board.

In the coaxial connector device according to the present invention thus mounted on the circuit board, on the circuit board facing portion of the insulating base, the contact connecting portion and the signal-connecting portion of the signal-joining contacting conductor and the ground-connecting portion of the grounding contacting conductor are provided to face each other with insulating material constituting the insulating base and air layer filling up the groove arranged for surrounding intermittently or continuously the contact connecting portion and the signal-connecting portion of the signal-joining contacting conductor. That is, the insulating material constituting the insulating base and the air layer filling up the groove are put between the signal-joining contacting conductor and the grounding contacting conductor on the insulating base. Since the dielectric constant of the insulating material constituting the insulating base is larger than 1, the dielectric constant of insulator including air between the signal-joining contacting conductor and the grounding contacting conductor on the insulating base on which the grooves are formed or the groove is formed is reduced in comparison with a case where only the insulating material constituting the insulating base is put between the signal-joining contacting conductor and the grounding contacting conductor on the insulating base on which any groove is not formed. Degree of reduction in the dielectric constant of insulator in such a case is influenced by the scale of the groove formed on the circuit board facing portion of the insulating base, that is, by the scale of the air layer filling up the groove.

Further, in the coaxial connector device according to the present invention mounted on the circuit board, the connecting portion provided in the grounding contacting conductor for connecting the annular end of the cylindrical side wall portion with the ground-connecting portion is deformed to become distant from the signal-joining contacting conductor. Accordingly, on the insulating base, the distance between the signal-joining contacting conductor and the grounding contacting conductor is expanded in comparison with a case where the connecting portion of the grounding contacting conductor is not deformed to become distant from the signal-joining contacting conductor. Degree of expansion in the distance between the signal-joining contacting conductor and the grounding contacting conductor in such a case is influenced by the scale of the deformation of the connecting portion of the grounding contacting conductor for becoming distant from the signal-joining contacting conductor.

The impedance between the signal-joining contacting conductor and the grounding contacting conductor on the insulating base is influenced by each of the dielectric constant of insulator including air between the signal-joining contacting conductor and the grounding contacting conductor and the distance between the signal-joining contacting conductor and the grounding contacting conductor, and the characteristic impedance of the coaxial connector device is determined by the impedance between the signal-joining contacting conductor and the grounding contacting conductor on the insulating base. Accordingly, in the coaxial connector device according to the present invention, since the dielectric constant of insulator including air between the signal-joining contacting conductor and the grounding contacting conductor on the insulating base is reduced in such a manner as described above and the distance between the signal-joining contacting conductor and the grounding contacting conductor on the insulating base is expanded also in such a manner as described above, the impedance between the signal-joining contacting conductor and the grounding contacting conductor on the insulating base is increased so that the characteristic impedance is increased effectively.

Effect and Advantages of the Invention

With the coaxial connector device according to the present invention mentioned above, by means of providing the groove between the ground-connecting portion of the grounding contacting conductor and the contact connecting portion of the signal-joining contacting conductor and between the ground-connecting portion of the grounding contacting conductor and the signal-connecting portion of the signal-joining contacting conductor on the circuit board facing portion of the insulating base in such a manner as to surround continuously or intermittently the contact connecting portion and the signal-connecting portion of the signal-joining contacting conductor and subjecting the connecting portion of the grounding contacting conductor provided for connecting the annular end of the cylindrical side wall portion with the ground-connecting portion to the deformation for becoming distant from the signal-joining contacting conductor, the characteristic impedance can be increased in comparison with a case wherein such a groove as mentioned above is not provided on the insulating base and the connecting portion of the grounding contacting conductor is not subjected to such a deformation as mentioned above. Then, by means of adjusting the scale of the groove formed on the circuit board facing portion of the insulating base or the degree in deformation of the connecting portion of the grounding contacting conductor, the degree in increase of the characteristic impedance of the coaxial connector device can be controlled, so that the characteristic impedance of the coaxial connector device can be increased without enlarging the coaxial connector device in its entirety so as to have an enlarged distance between the signal-joining contacting conductor and the grounding contacting conductor.

As a result, with the coaxial connector device according to the present invention, miniaturization on the whole can be compatible with presentation of desirable and appropriate characteristic impedance which is, for example, of a value matching with characteristic impedance presented by a coaxial cable connected to a mating coaxial connector device operative to engage with the coaxial connector device.

MODE PREFERABLE FOR WORKING OF THE INVENTION

A mode preferable for working of the present invention will be explained with first to third embodiments of coaxial connector device according to the present invention described below.

First Embodiment

Figure 1:
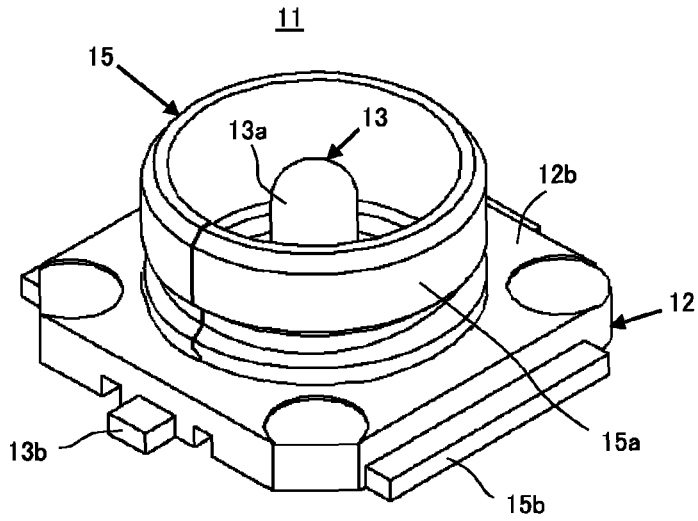
FIG. 1 is a schematic top side perspective view showing a first embodiment of coaxial connector device according to the present invention.
Figure 2:
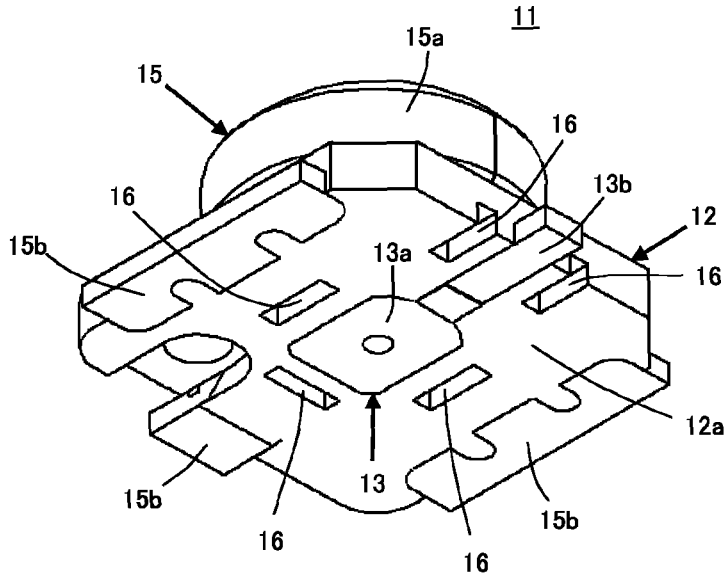
FIG. 2 is a schematic bottom side perspective view showing the first embodiment of coaxial connector device according to the present invention.
Figure 3:
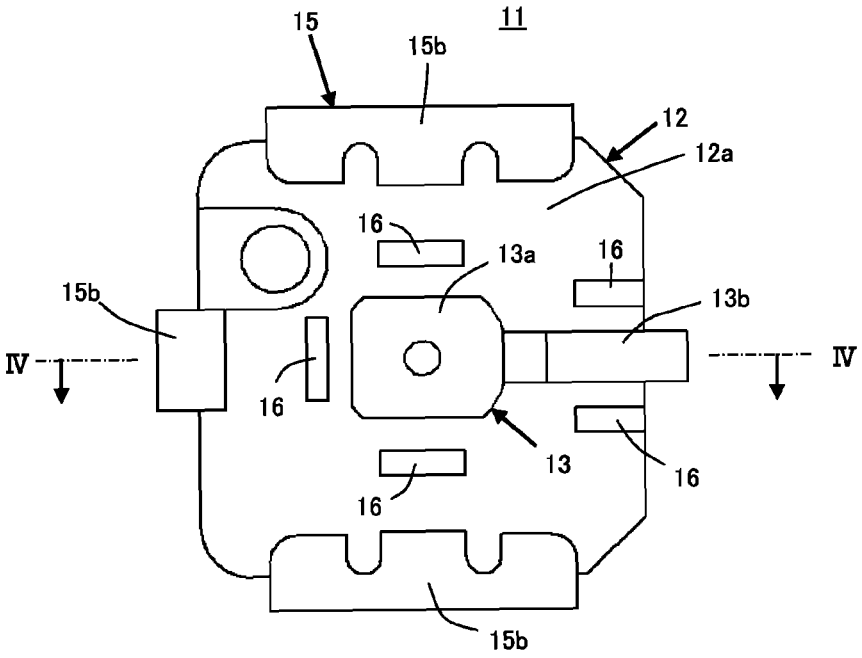
FIG. 3 is a schematic bottom view showing the first embodiment of coaxial connector device according to the present invention.

FIG. 1 (a schematic top side perspective view), FIG. 2 (a schematic bottom side perspective view) and FIG. 3 (a bottom view) show a first embodiment of coaxial connector device according to the present invention.

Referring to FIGS. 1, 2 and 3, a coaxial connector device 11, which constitutes the first embodiment of coaxial connector device according to the present invention, is designed to be mounted on a circuit board for practical use. When the coaxial connector device 11 is put to its practical use, another coaxial connector device (hereinafter, referred to as a mating coaxial connector device) is engaged with the coaxial connector device 11 mounted on the circuit board. The coaxial connector device 11 comprises an insulating base 12 made of insulating material such as plastics or the like to be placed on a surface of the circuit board on which the coaxial connector device 11 is mounted. The insulating base 12 is provided with a circuit board facing portion 12*a* which is a bottom end portion of the insulating base 12 for facing close the surface of the circuit board on which the coaxial connector device 11 is mounted and an upper end portion 12*b* opposite to the circuit board facing portion 12*a*. A round perforation 12*c* (not shown in FIGS. 1 to 3, but shown in FIG. 4 mentioned later) is formed at a central portion of the insulating base 12 so as to pass through both the circuit board facing portion 12*a* and the upper end portion 12*b*.

The coaxial connector device 11 comprises also a signal-joining contacting conductor 13 which is made of resilient conductive material such as a metal plate and put in the round perforation 12*c* formed at the central portion of the insulating base 12 for passing through the same from the side of the circuit board facing portion 12*a* to the side of the upper end portion 12*b* to be fixed to the insulating base 12. The signal-joining contacting conductor 13 has a contact connecting portion 13*a* which forms a column-shaped portion extending from the circuit board facing portion 12*a* of the insulating base 12 through the round perforation 12*c* to the upper end portion 12*b* of the insulating base 12 to project from the insulating base 12 and a signal-connecting portion 13*b* which extends from the contact connecting portion 13*a* to the outside of the insulating base 12 on the circuit board facing portion 12*a* of the insulating base 12. The contact connecting portion 13*a* is operative to come into contact with a signal-joining contacting conductor of the mating coaxial connector device engaging with the coaxial connector device 11 and the signal-connecting portion 13*b* is operative to be connected, for example, by soldering to a signal terminal provided on the circuit board having the surface on which the insulating base 12 is placed.

The coaxial connector device 11 further comprises a grounding contacting conductor 15 made of resilient conductive material such as a metal plate to be fixed to the insulating base 12 for surrounding the signal-joining contacting conductor 13 on the upper end portion 12*b* of the insulating base 12. The grounding contacting conductor 15 has a cylindrical side wall portion 15*a* put on the upper end portion 12*b* of the insulating base 12 for surrounding the contact connecting portion 13*a* of the signal-joining contacting conductor 13 along the surface of the circuit board on which the insulating base 12 is placed, a plurality of ground-connecting portions 15*b* which are provided around the contact connecting portion 13*a* and the signal-connecting portion 13*b* of the signal-joining contacting conductor 13 on the circuit board facing portion 12*a* of the insulating base 12 and each of which extends to the outside of the insulating base 12, and a plurality of connecting portions 15*c* (not shown in FIGS. 1 to 3, but shown in FIG. 4 mentioned later), each of which is provided between an annular end of the cylindrical side wall portion 15*a* supported by the insulating base 12 and the ground-connecting portion 15*b*. The cylindrical side wall portion 15*a* is operative to come into contact with a grounding contacting conductor of the mating coaxial connector device engaging with the coaxial connector device 11, each of the connecting portions 15*c* extends from the annular end of the cylindrical side wall portion 15*a* forward the outside of the cylindrical side wall portion 15*a* for connecting electrically the annular end of the cylindrical side wall portion 15*a* with the ground-connecting portion 15*b*, and each of the ground-connecting portions 15*b* is operative to be connected, for example, by soldering to a ground-potential terminal provided on the circuit board having the surface on which the insulating base 12 is placed.

As shown in FIGS. 2 and 3, the ground-connecting portions 15*b* of the grounding contacting conductor 15 are arranged on the circuit board facing portion 12*a* of the insulating base 12 to surround on three sides the contact connecting portion 13*a* of the signal-joining contacting conductor 13 provided at a central portion of the circuit board facing portion 12*a*. Between the signal-joining contacting conductor 13 and the grounding contacting conductor 15, in more detail, between the contact connecting portion 13*a* of the signal-joining contacting conductor 13 and the ground-contacting portion 15*b* of the grounding contacting conductor 15 and between the signal-connecting portion 13*b* of the signal-joining contacting conductor 13 and the ground-contacting portion 15*b* of the grounding contacting conductor 15 on the circuit board facing portion 12*a* of the insulating base 12, a groove 16 constituted with a plurality of groove segments, for example, five groove segments arranged intermittently, is formed so as to surround intermittently the contact connecting portion 13*a* and the signal-connecting portion 13*b* of the signal-joining contacting conductor 13 and to open on a common single plane on the circuit board facing portion 12*a* of the insulating base 12. The three of five groove segments of the groove 16 are arranged to surround the contact connecting portion 13*a* of the signal-joining contacting conductor 13 on three sides and the remaining two of five groove segments of the groove 16 constitute a pair of groove segments arranged to face each other with the signal-connecting portion 13*b* of the signal-joining contacting conductor 13 between. The three of five groove segments of the groove 16, which are arranged to surround the contact connecting portion 13*a* of the signal-joining contacting conductor 13 on three sides, include another pair of groove segments arranged to face each other with the contact connecting portion 13*a* of the signal-joining contacting conductor 13 between.

Figure 4:
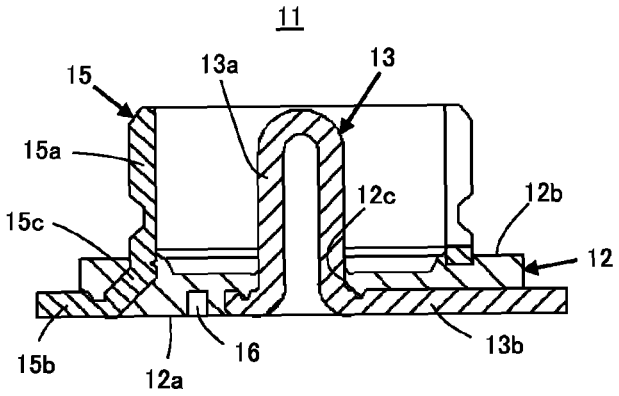
FIG. 4 is a schematic cross sectional view taken along line IV-IV in FIG. 3.

Consequently, the groove 16 constituted with five groove segments is in existence between the signal-joining contacting conductor 13 and the grounding contacting conductor 15 on the insulating base 12. In FIG. 4 showing a cross sectional view taken along line IV-IV in FIG. 3, the groove 16 provided between the contact connecting portion 13*a* of the signal-joining contacting conductor 13 and the ground-connecting portion 15*b* of the grounding contacting conductor 15 on the insulating base 12 is shown. Although the groove 16 is constituted with five groove segments in each of FIGS. 2 and 3, it is to be understood that the groove segments constituting the groove 16 formed on the circuit board facing portion 12*a* of the insulating base 12 should not be limited in number to five but should be selected in number at free will under the necessity of surrounding intermittently the contact connecting portion 13*a* and the signal-connecting portion 13*b* of the signal-joining contacting conductor 13.

Further, as shown in FIG. 4, at lease one of the connecting portions 15*c* provided between the annular end of the cylindrical side wall portion 15*a* and the ground-connecting portion 15*b* in the grounding contacting conductor 15 is deformed to be bent toward the outside of the insulating base 12 for becoming distant from the signal-joining contacting conductor 13. Thereby, the distance between the signal-joining contacting conductor 13 and the grounding contacting conductor 15 on the insulating base 12 is enlarged in comparison with the case where none of the connecting portions 15*c* is deformed for becoming distant from the signal-joining contacting conductor 13.

In the coaxial connector device 11 thus constituted, on the insulating base 12, the signal-joining contacting conductor 13 and the grounding contacting conductor 15 are provided to face each other with the insulating material such as plastics or the like constituting the insulating base 12 and air layer filling up the groove 16 which is formed on the circuit board facing portion 12*a* of the insulating base 12. That is, the insulating material constituting the insulating base 12 and the air layer filling up the groove 16 are put between the signal-joining contacting conductor 13 and the grounding contacting conductor 15 on the insulating base 12. Since the dielectric constant of the insulating material such as plastics or the like constituting the insulating base 12 is higher than 1, the dielectric constant of insulator including air between the signal-joining contacting conductor 13 and the grounding contacting conductor 15 on the insulating base 12 on which the grooves 16 are formed is reduced in comparison with a case where only the insulating material constituting the insulating base 12 is put between the signal-joining contacting conductor 13 and the grounding contacting conductor 15 on the insulating base 12 on which any groove is not formed. Degree of reduction in the dielectric constant of insulator in such a case is influenced by the scale of the groove 16 formed on the circuit board facing portion 12*a* of the insulating base 12, that is, by the scale of the air layer filling up the groove 16.

With the reduction in the dielectric constant of insulator including air between the signal-joining contacting conductor 13 and the grounding contacting conductor 15 on the insulating base 12 brought about in such a manner as mentioned above, impedance between the signal-joining contacting conductor 13 and the grounding contacting conductor 15 is increased in comparison with the case where any groove is not formed on the circuit board facing portion 12*a* of the insulating base 12 so that characteristic impedance of the coaxial connector device 11 which is determined by the impedance between the signal-joining contacting conductor 13 and the grounding contacting conductor 15 is also increased in comparison with the case where any groove is not formed on the circuit board facing portion 12*a* of the insulating base 12.

Further, in the coaxial connector device 11, at least one of the connecting portions 15*c* provided in the grounding contacting conductor 15 for connecting electrically the annular end of the cylindrical side wall portion 15*a* with the ground-connecting portion 15*b* is deformed to be bent toward the outside of the insulating base 12 for becoming distant from the signal-joining contacting conductor 13 and thereby the distance between the signal-joining contacting conductor 13 and the grounding contacting conductor 15 on the insulating base 12 is enlarged in comparison with the case where none of the connecting portions 15*c* is deformed for becoming distant from the signal-joining contacting conductor 13, as described above. Thereby, the impedance between the signal-joining contacting conductor 13 and the grounding contacting conductor 15 is increased in comparison with the case where none of the connecting portions 15*c* is deformed for becoming distant from the signal-joining contacting conductor 13 and, as a result, that characteristic impedance of the coaxial connector device 11 which is determined by the impedance between the signal-joining contacting conductor 13 and the grounding contacting conductor 15 is also increased in comparison with the case where none of the connecting portions 15*c* is deformed for becoming distant from the signal-joining contacting conductor 13.

According to the result of the experiment conducted previously with making use of the coaxial connector device 11 and a reference coaxial connector device which is constituted basically in the same manner as the coaxial connector device 11 except the groove 16 and the connecting portions 15*c* of the grounding contacting conductor 15 and in which any groove is not formed on a circuit board facing portion of an insulating base and none of connecting portions of a grounding contacting conductor is deformed for becoming distant from a signal-joining contacting conductor, for example, characteristic impedance of the reference coaxial connector device was about 40.2Ω, but on the other hand, the characteristic impedance of the coaxial connector device 11 was apparently larger than about 40.2Ω and it was possible for the coaxial connector device 11 to present the characteristic impedance of a value extremely close to 50Ω, such as about 49.7Ω, and contingent on a selected scale of the groove 16.

With the coaxial connector device 11, by means of adjusting the scale of the groove 16 formed on the circuit board facing portion 12*a* of the insulating base 12 or the degree in deformation of the connecting portion 15*c* provided between the annular end of the cylindrical side wall portion 15*a* and the ground-connecting portion 15*b* of the grounding contacting conductor 15, the degree in increase of the characteristic impedance can be controlled. That is, the characteristic impedance of the coaxial connector device 11 can be increased without scaling up the coaxial connector device 11 for enlarging the distance between the signal-joining contacting conductor 13 and the grounding contacting conductor 15.

As a result, with the coaxial connector device 11, miniaturization on the whole can be compatible with presentation of desirable and appropriate characteristic impedance which is of a value matching with characteristic impedance of, for example, 50Ω presented by a coaxial cable connected to the mating coaxial connector device operative to engage with the coaxial connector device 11.

Figure 5:
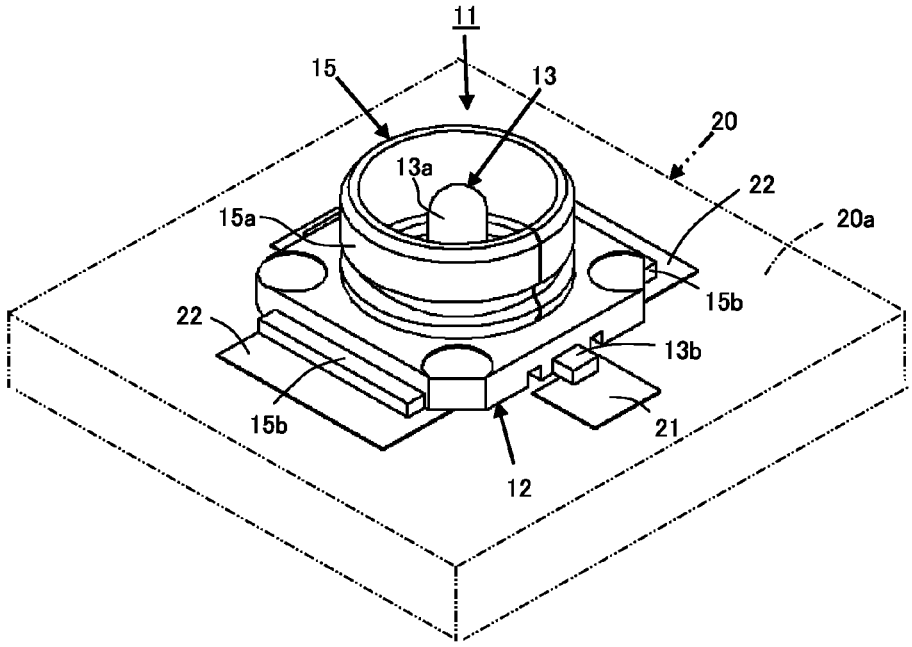
FIG. 5 is a schematic top side perspective view showing a situation wherein the first embodiment of coaxial connector device according to the present invention is mounted on a circuit board.

FIG. 5 shows a situation wherein the coaxial connector device 11 is mounted on a circuit board 20. In FIG. 5, the insulating base 12 of the coaxial connector device 11 is placed on a surface 20*a* of the circuit board 20 so as to cause the circuit board facing portion 12*a* of the insulating base 12 to face close the surface 20*a* of the circuit board 20. The signal-connecting portion 13*b* of the signal-joining contacting conductor 13 is connected, for example, by soldering to a signal terminal 21 provided on the surface 20*a* of the circuit board 20 and each of the ground-connecting portions 15*b* of the grounding contacting conductor 15 is connected, for example, by soldering to a ground-potential terminal 22 provided on the surface 20*a* of the circuit board 20.

Figure 6:
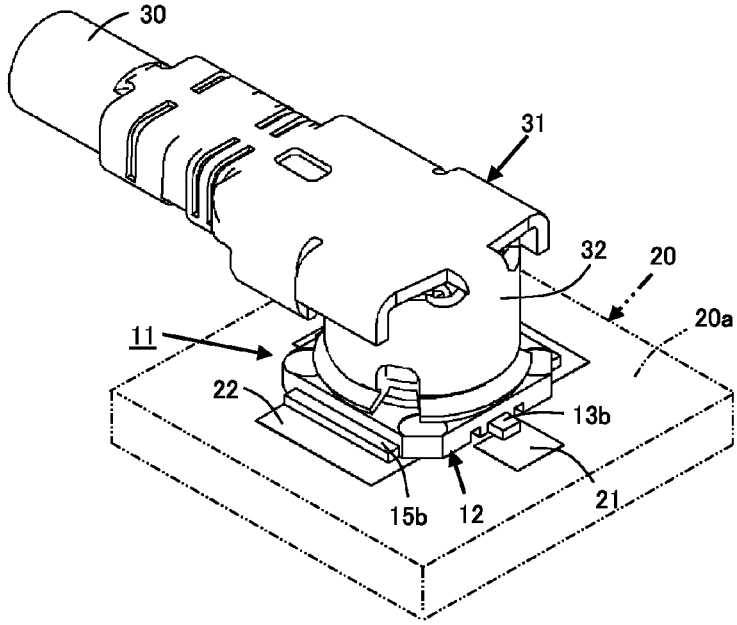
FIG. 6 is a schematic top side perspective view showing a situation wherein the first embodiment of coaxial connector device according to the present invention is mounted on the circuit board and a mating coaxial connector device is engaged with the first embodiment.

FIG. 6 shows a situation wherein the coaxial connector device 11 is mounted on the circuit board 20 and a mating coaxial connector device 31 to which a coaxial cable 30 is connected is engaged with the coaxial connector device 11. In FIG. 6, a grounding contacting conductor 32 of the mating coaxial connector device 31 is connected with the grounding contacting conductor 15 of the coaxial connector device 11 and, in the inside of the grounding contacting conductor 32 of the mating coaxial connector device 31 (not shown in FIG. 6), a signal-joining contacting conductor of the mating coaxial connector device 31 is connected with the signal-joining contacting conductor 13 of the coaxial connector device 11. Thereby, high-frequency signals from the circuit board 20 are transmitted through the coaxial connector device 11, the mating coaxial connector device 31 to the coaxial cable 30 and high-frequency signals from the coaxial cable 30 are transmitted through the mating coaxial connector device 31 and the coaxial connector device 11 to the circuit board 20.

Second Embodiment

Figure 7:
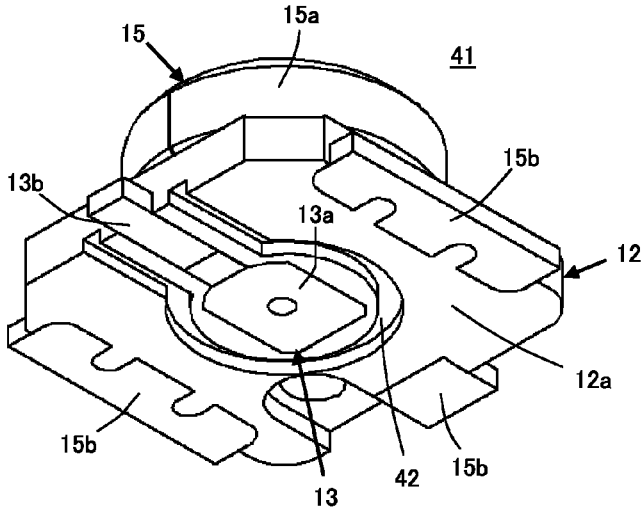
FIG. 7 is a schematic bottom side perspective view showing a second embodiment of coaxial connector device according to the present invention.
Figure 8:
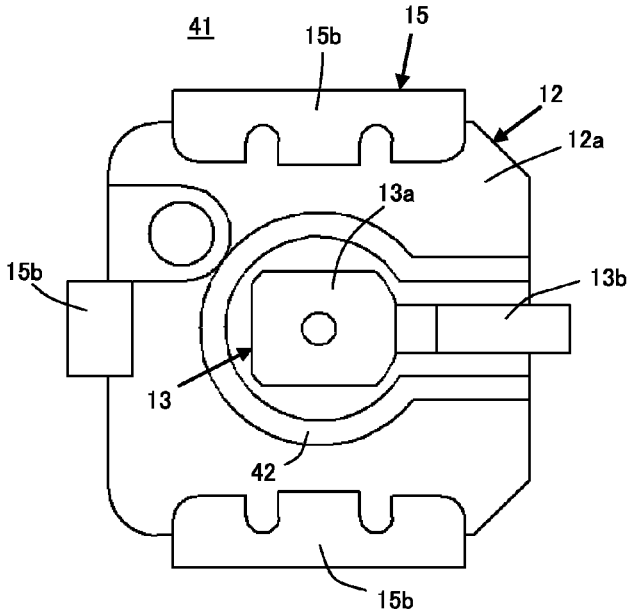
FIG. 8 is a schematic bottom view showing the second embodiment of coaxial connector device according to the present invention.

FIG. 7 (a schematic bottom side perspective view) and FIG. 8 (a schematic bottom view) show a second embodiment of coaxial connector device according to the present invention.

Referring to FIGS. 7 and 8, a coaxial connector device 41, which constitutes the second embodiment of coaxial connector device according to the present invention, is also designed to be mounted on a circuit board for practical use. When the coaxial connector device 41 is put to its practical use, a mating coaxial connector device is engaged with the coaxial connector device 41 mounted on the circuit board. A major part of the coaxial connector device 41 is constituted in the same manner as the coaxial connector device 11 shown in FIGS. 1 to 4 and described above. In FIGS. 7 and 8, various parts and portions of the coaxial connector device 41 corresponding to those of the coaxial connector device 11 are marked with the same references common to FIGS. 1 to 4 and further explanations thereof will be omitted.

In the coaxial connector device 41, a groove 42 is formed in continuity on a circuit board facing portion 12*a* of an insulating base 12 in place of the groove 16 constituted with the plural groove segments arranged intermittently in the coaxial connector device 11 mentioned above. The groove 42 is arranged continuously between a signal-joining contacting conductor 13 and a grounding contacting conductor 15, in more detail, between the contact connecting portion 13*a* of the signal-joining contacting conductor 13 and the ground-contacting portion 15*b* of the grounding contacting conductor 15 and between the signal-connecting portion 13*b* of the signal-joining contacting conductor 13 and the ground-contacting portion 15*b* of the grounding contacting conductor 15 on the circuit board facing portion 12*a* of the insulating base 12 so as to surround continuously the contact connecting portion 13*a* and the signal-connecting portion 13*b* of the signal-joining contacting conductor 13 and to open on a single plane on the circuit board facing portion 12*a* of the insulating base 12. Then, the groove 42 is provided with an annular portion arranged around the contact connecting portion 13*a* of the signal-joining contacting conductor 13 and a pair of linear portions arranged to face each other with the signal-connecting portion 13*b* of the signal-joining contacting conductor 13 between. Other parts and portions of the coaxial connector device 41 are constituted in the same manner as the coaxial connector device 11 mentioned above.

With the coaxial connector device 41 thus constituted, in which the groove 42 arranged continuously is formed on the circuit board facing portion 12*a* of the insulating base 12, the effect and advantages corresponding to those obtained with the coaxial connector device 11 can be also obtained. The effect and advantages obtained by means of the groove 42 arranged continuously for surrounding the contact connecting portion 13*a* and the signal-connecting portion 13*b* of the signal-joining contacting conductor 13 in the coaxial connector device 41 is more remarkable than those obtained by means of the groove 16 constituted with the plural groove segments arranged intermittently for surrounding intermittently the contact connecting portion 13*a* and the signal-connecting portion 13*b* of the signal-joining contacting conductor 13 in the coaxial connector device 11.

Third Embodiment

Figure 9:
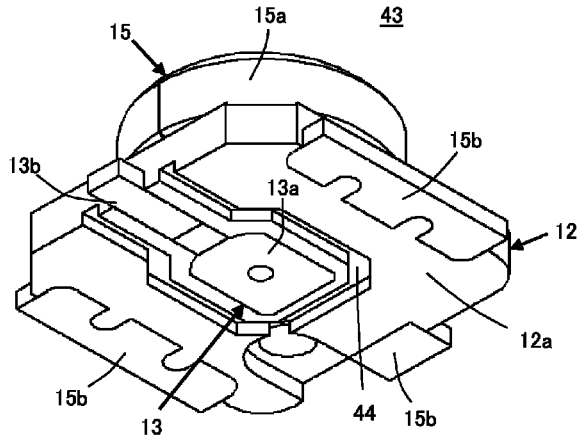
FIG. 9 is a schematic bottom side perspective view showing a third embodiment of coaxial connector device according to the present invention.
Figure 10:
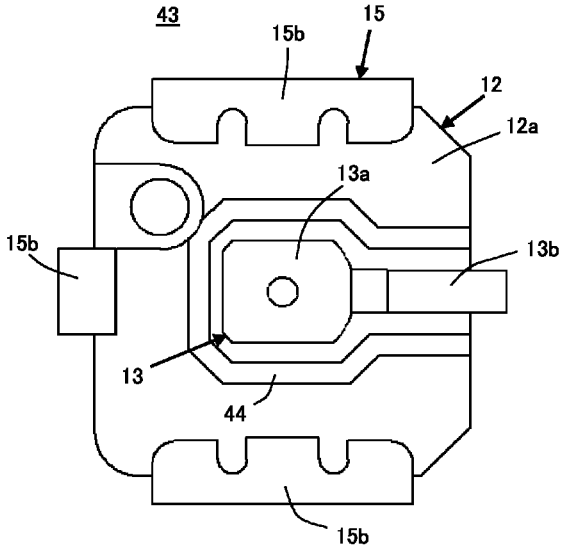
FIG. 10 is a schematic bottom view showing the third embodiment of coaxial connector device according to the present invention.

FIG. 9 (a schematic bottom side perspective view) and FIG. 10 (a schematic bottom view) show a third embodiment of coaxial connector device according to the present invention.

Referring to FIGS. 9 and 10, a coaxial connector device 43, which constitutes the third embodiment of coaxial connector device according to the present invention, is also designed to be mounted on a circuit board for practical use. When the coaxial connector device 43 is put to its practical use, a mating coaxial connector device is engaged with the coaxial connector device 43 mounted on the circuit board. A major part of the coaxial connector device 43 is constituted also in the same manner as the coaxial connector device 11 shown in FIGS. 1 to 4 and described above. In FIGS. 9 and 10, various parts and portions of the coaxial connector device 43 corresponding to those of the coaxial connector device 11 are marked with the same references common to FIGS. 1 to 4 and further explanations thereof will be omitted.

In the coaxial connector device 43, a groove 44 is formed in continuity on a circuit board facing portion 12*a* of an insulating base 12 in place of the grooves 16 constituted with the plural groove segments arranged intermittently in the coaxial connector device 11 mentioned above. The groove 44 is arranged continuously between a signal-joining contacting conductor 13 and a grounding contacting conductor 15, in more detail, between the contact connecting portion 13*a* of the signal-joining contacting conductor 13 and the ground-contacting portion 15*b* of the grounding contacting conductor 15 and between the signal-connecting portion 13*b* of the signal-joining contacting conductor 13 and the ground-contacting portion 15*b* of the grounding contacting conductor 15 on the circuit board facing portion 12*a* of the insulating base 12 so as to surround continuously the contact connecting portion 13*a* and the signal-connecting portion 13*b* of the signal-joining contacting conductor 13 and to open on a single plane on the circuit board facing portion 12*a* of the insulating base 12. Then, the groove 44 is provided with an annular portion in the shape of rectangle having rounded angles arranged around the contact connecting portion 13*a* of the signal-joining contacting conductor 13 and a pair of linear portions arranged to face each other with the signal-connecting portion 13*b* of the signal-joining contacting conductor 13 between. Other parts and portions of the coaxial connector device 43 are constituted in the same manner as the coaxial connector device 11 mentioned above.

With the coaxial connector device 43 thus constituted, in which the groove 44 arranged continuously is formed on the circuit board facing portion 12*a* of the insulating base 12, the effect and advantages corresponding to those obtained with the coaxial connector device 11 can be also obtained. The effect and advantages obtained by means of the groove 44 arranged continuously for surrounding the contact connecting portion 13*a* and the signal-connecting portion 13*b* of the signal-joining contacting conductor 13 in the coaxial connector device 43 is more remarkable than those obtained by means of the groove 16 constituted with the plural groove segments arranged intermittently for surrounding intermittently the contact connecting portion 13*a* and the signal-connecting portion 13*b* of the signal-joining contacting conductor 13 in the coaxial connector device 11.

APPLICABILITY FOR INDUSTRIAL USE

As apparent from the above description, the coaxial connector device according to the present invention can be applied widely to various kinds of electronic apparatus or the like as a coaxial connector which is operative to be mounted on a circuit board for transmitting signals from the circuit board to the outside thereof or for taking signals into the circuit board from the outside thereof under a condition of electro-magnetic shield and with which miniaturization on the whole is compatible with presentation of a desirable and appropriate characteristic impedance which is, for example, of a value matching with characteristic impedance presented by a coaxial cable connected to a mating coaxial connector device operative to engage with the coaxial connector device.

DESCRIPTION OF REFERENCES IN THE DRAWINGS

11, 41, 43 . . . coaxial connector device, 12 . . . insulating base, 12*a* . . . circuit board facing portion, 12*b* . . . upper end portion, 13 . . . signal-joining contacting conductor, 13*a* . . . contact connecting portion, 13*b* . . . signal-connecting portion, 15 . . . grounding contacting conductor, 15*a* . . . cylindrical side wall portion, 15*b* . . . ground-connecting portion, 15*c* . . . connecting portion, 16, 42, 44 . . . groove, 20 . . . circuit board, 21 . . . signal terminal, 22 . . . ground-potential terminal, 30 . . . coaxial cable, 31 . . . mating coaxial connector device

The invention claimed is:

1. A coaxial connector device comprising:

an insulating base provided to be placed on a surface of a circuit board, a signal-joining contacting conductor fixed to the insulating base with a contact connecting portion for projecting from the insulating base and an signal-connecting portion provided on a portion of the insulating base for facing close the surface of the circuit board to be connected to a signal terminal provided on the circuit board, and a grounding contacting conductor fixed to the insulating base and provided with a cylindrical side wall portion for surrounding the contact connecting portion of the signal-joining contacting conductor along the surface of the circuit board, a plurality of ground-connecting portions provided around the contact connecting portion and the signal-connecting portion of the signal-joining contacting conductor on said portion of the insulating base to be connected to ground-potential terminals provided on the circuit board, and a plurality of connecting portions provided for connecting an annular end of the cylindrical side wall portion and each of the ground-connecting portions, wherein at least one groove is formed between the ground-connecting portion of the grounding contacting conductor and the contact connecting portion of the signal-joining contacting conductor and between the ground-connecting portion of the grounding contacting conductor and the signal-connecting portion of the signal-joining contacting conductor on said portion of the insulating base for surrounding continuously or intermittently the contact connecting portion and the signal-connecting portion of the signal-joining contacting conductor, and wherein at least one of the connecting portions is deformed to be bent away from and to become distant from the signal-joining contacting conductor.

2. The coaxial connector device according to claim 1, wherein said groove is provided to open on a single plane on said portion of the insulating base.

3. The coaxial connector device according to claim 1, wherein said groove is constituted with a plurality of groove segments arranged intermittently which include a first pair of groove segments arranged to face each other with the contact connecting portion of the signal-joining contacting conductor between said first pair of groove segments and a second pair of groove segments arranged to face each other with the signal-connecting portion of the signal-joining contacting conductor between said second pair of groove segments.

4. The coaxial connector device according to claim 1, wherein said groove is formed in continuity and provided with an annular portion arranged around the contact connecting portion of the signal-joining contacting conductor and a pair of linear portions arranged to face each other with the signal-connecting portion of the signal-joining contacting conductor between said pair of linear portions.

5. The coaxial connector device according to claim 1, wherein said connecting portion provided in the grounding contacting conductor extends from the annular end of the cylindrical side wall portion toward the outside of the cylindrical side wall portion.

* * * * *